United States Patent [19]

Lam et al.

[11] Patent Number: 5,009,802

[45] Date of Patent: Apr. 23, 1991

[54] PHENOLIC ANTIOXIDANT COMPOSITION

[75] Inventors: William Y. Lam, Ballwin; Gregory P. Liesen, St. Louis, both of Mo.

[73] Assignee: Ethyl Corporation, Richmond, Va.

[21] Appl. No.: 442,657

[22] Filed: Nov. 29, 1989

[51] Int. Cl.[5] ..... C10M 135/02

[52] U.S. Cl. ..... 252/48.2; 568/75

[58] Field of Search ..... 252/48.2; 568/75

[56] References Cited

U.S. PATENT DOCUMENTS

| | | | |
|---|---|---|---|
| 2,785,131 | 3/1957 | O'connor | 252/48.2 |
| 2,810,765 | 10/1957 | Neuworth et al. | 252/48.2 |
| 3,057,926 | 10/1962 | Coffield | 252/48.2 |
| 3,168,480 | 2/1965 | Worrel | 252/48.2 |
| 3,211,794 | 10/1965 | Coffield | 252/48.2 |
| 3,929,654 | 12/1975 | Brewster et al. | 252/48.2 |
| 3,951,830 | 4/1976 | Karn | 252/42.7 |
| 4,309,293 | 1/1982 | Braid | 252/48.2 |
| 4,740,321 | 4/1988 | Davis et al. | 252/48.2 |

*Primary Examiner*—Prince E. Willis, Jr.
*Assistant Examiner*—Ellen M. McAvoy
*Attorney, Agent, or Firm*—David M. Bunnell

[57] ABSTRACT

A partially sulfurized, phenolic antioxidant having good copper corrosion properties is prepared by reacting a liquid mixture of phenols, which mixtures includes at least one reactive, hindered phenol, with sulfur chloride in proportions to provide from about 0.3 to 0.7 gram atoms of sulfur per mole of reactive phenol.

19 Claims, No Drawings

PHENOLIC ANTIOXIDANT COMPOSITION

BACKGROUND OF THE INVENTION

This invention relates generally to sulfurized phenols useful as antioxidants and, more specifically to the preparation of a liquid, partially sulfurized, hindered phenol composition which is an effective antioxidant in lubricating oils without causing excessive copper corrosion.

The preparation of a liquid lubricant oil additive mixture of 45–75 wt % ortho-alkylphenol and certain amounts of mono, di, tri and tetrasulfides of the phenol by the reaction of the phenol with elemental sulfur using an organic amine catalyst is disclosed in U.S. Pat. No. 3,929,654. It is also reported in this patent that sulfurized alkylphenols prepared by reacting an alkylphenol with sulfur mono- or dichloride tend to cause copper corrosion probably due to the presence of corrosive sulfur species such as sulphochlorinated alkyl phenol.

We have now unexpectedly found that a sulfurized, hindered alkyl phenol composition which is an effective antioxidant with acceptable copper corrosion properties can be prepared by using certain proportions of a sulfur chloride.

In accordance with this invention, there is provided a liquid, partially sulfurized, hindered phenol product prepared by the process comprising reacting a liquid mixture of phenols, at least about 50 weight percent of said mixture consisting of one or more reactive, hindered phenols, with a sulfur chloride in proportions to provide from about 0.3 to 0.7 gram atoms of sulfur per mole of reactive, hindered phenol, and recovering the liquid product.

Also provided are lubricating oil and fuel compositions containing antioxidant effective amounts of the above liquid, partially sulfurized, hindered phenol product.

An advantage of this invention is the liquid nature of the sulfur-bridged, alkylphenol product which facilitates its handling and dissolving in fuels, lubricating oils and other oxygen sensitive materials. The initial phenol mixture to be sulfurized should contain at least two different phenols at least one of which is a hindered phenol having at least one hydrogen in the ortho or para position to the hydroxyl group in proportions to provide a liquid product at ambient temperatures (20° C.–25° C.) from which solid material will not separate on standing. By hindered phenol is meant that the phenol is substituted in at least one ortho position with a branched chain $C_3$ to $C_{12}$ alkyl group and preferably a $C_4$–$C_6$ alkyl group. Examples of suitable ortho-alkylphenols include:

2-tert-butylphenol
2,6-di-tert-butylphenol
2,4-di-tert-butylphenol
2-isopropylphenol
2,6-diisopropylphenol
2,4-diisopropylphenol
2-sec-butylphenol
2,6-di-sec-butylphenol
2,4-sec-butylphenol
2-tert-hexylphenol
2,6-di-tert-hexylphenol
2-tert-butyl-p-cresol
2-tert-butyl-o-cresol
2-tert-dodecylphenol 2-tert-dodecyl-p-cresol
2-tert-decyl-o-cresol
2-tert-butyl-6-isopropylphenol Suitable mixtures contain at least about 50 weight percent, preferably from about 70 to 90 weight percent, of one or more reactive hindered phenols with the remainder, if any, being one or more other phenols. By a reactive phenol is meant a phenol having at least one hydrogen in the ortho or para position to the hydroxyl group. The mixture more preferably contains at least about 50 weight percent, and most preferably from about 70 to 85 weight percent, of a di-ortho, branched chain alkyl phenol such as 2,6-di-tert-butyl phenol.

The phenolic mixture is reacted with a sulfur chloride, e.g. sulfur mono- or dichloride, in an amount of sulfur chloride to provide from about 0.3 to 0.7 gram atom of sulfur per mole of reactive phenol in the mixture. For sulfur monochloride, this is equivalent to only about 0.15 to 0.35 moles of sulfur monochloride per mole of phenol which is significantly less than a stoichiometric amount. These proportions provide an effective sulfurized antioxidant which has good copper corrosion properties. At least about 30 weight percent, and usually from about 40 to 75 weight percent of the reactive phenols in the partially sulfurized product mixture remain unreacted.

The sulfurization reaction is exothermic and the reaction temperature is preferably kept at from about 15° C. to 70° C. (most preferably from about 35° C. to 55° C.) by cooling and/or by controlling the rate of sulfur chloride addition to the phenolic mixture. The addition usually takes from about 1 to 3 hours. Heat may be added to finish the reaction and keep the temperature within the preferred range. Higher or lower temperatures can be used so long as the reaction is completed without decomposing the product or producing a significant amount of side products. The product can be recovered either by vacuum stripping or purging the reaction mixture with an inert gas and then, optionally, filtering the mixture.

The liquid antioxidant product has a sulfur content of preferably from about 5 to 8 wt percent and includes, depending upon the phenols in the initial mixture, mixtures of sulfur bridged bis and/or polyphenol compounds having from 1 to 6 or more sulfur atoms per bridge.

The products are added to lubricating compositions or liquid organic fuels in antioxidant effective amounts which generally range from about 0.05 to 5.0 wt percent, and preferably 0.1 to 2.0 wt percent, based on the total weight of composition.

The products can be added to the oil or fuel in the form of additive concentrates usually containing a diluent oil or solvent and other additives. The amount of product in the concentrates will generally vary from about 0.5 to 50 weight percent or more.

Lubricating composition base stock oils include natural and synthetic oils having viscosities which generally range from about 2.5 to 12 cps at 100° C. depending upon the particular lubricant application. The compounds of the invention are especially useful in crankcase lubricants where they act as antioxidants and reduce sludge formation.

Advantageous results also are achieved by employing the antioxidant additives of the present invention in base oils conventionally employed in and/or adapted for use as power transmitting fluids such as automatic transmission fluids, tractor fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

The additives of the present invention may be suitably incorporated into synthetic base oils such as alkyl esters of dicarboxylic acids, polyglycols and alcohols, polyalphaolefins, alkyl benzenes, organic esters of phosphoric acids, polysilicone oils, etc.

Natural base oils include mineral lubricating oils which may vary widely as to their crude source, e.g., whether paraffinic, naphthenic, mixed, paraffinic-naphthenic, and the like; as well as to their formation, e.g., distillation range, straight run or cracked, hydrorefined, solvent extracted and the like.

More specifically, the natural lubricating oil base stocks which can be used in the compositions of this invention may be straight mineral lubricating oil or distillates derived from paraffinic, naphthenic, asphaltic, or mixed base crudes, or, if desired, various blends oils may be employed as well as residuals, particularly those from which asphaltic constituents have been removed. The oils may be refined by conventional methods using acid, alkali, and/or clay or other agents such as aluminum chloride, or they may be extracted oils produced, for example, by solvent extraction with solvents of the type of phenol, sulfur dioxide, furfural, dichlorodiethyl ether, nitrobenzene, crotonaldehyde, molecular sieves, etc.

The compositions of the invention can also be employed in gasoline, gasohol and in middle distillate fuels such as diesel fuel, furnace oil and jet fuel.

The invention is further illustrated by, but is not intended to be limited to, the following examples wherein parts and percentages are by weight unless otherwise indicated.

EXAMPLE 1

A 4-neck reactor was equipped with a mechanical stirrer, condenser, thermometer and addition funnel. The off-gas outlet of the condenser was connected to a HCl scrubber containing an aqueous NaOH solution. A charge of 1,169.0 grams of a phenolic mixture containing about 75 wt % 2,6-di-tert-butyl phenol, 2 wt % 2,4-di-tert-butyl phenol, 10 wt % ortho-tert-butyl phenol and 13 wt % 2,4,6-tri-tert-butyl phenol (5.15 moles of reactive phenols) was placed in the reactor and agitation started. Sulfur monochloride, $S_2Cl_2$, 174 grams (1.29 moles, 2.58 gram atoms of sulfur), so as to provide about 0.5 gram atoms of sulfur per mole of reactive phenols, was added dropwise over a period of about 2.5 hours. The temperature rose due to the exotherm to 45° C. After the $S_2Cl_2$ addition was completed, the reaction mixture was maintained at about 55° C. with heating for 1.0 hour. The batch was purged with $N_2$ for 30 minutes followed by vacuum stripping at 55° C. with the batch held under full vacuum (30–50 mm Hg) for about 30 minutes. The vacuum was broken and 1,246.4 grams of product was collected. The clear amber liquid product contained 6.7 wt percent sulfur and 0.6 wt percent chlorine.

COPPER CORROSION TEST (D-130)

Lubricant compositions of a fully formulated 5W-30 crankcase lubricant oil containing 0.75 and 1.2 weight percent of the product prepared in Example 1 were tested in the D-130 test at 121° C. for 3 hours.

This test indicates the resistance of the lubricant to corrosion of copper. A freshly refinished copper strip is placed in a 1×6 in. (25.4×152.4 mm.) test tube with 25 grams of the oil being tested. The tube is placed in a heated bath for the proper period of time. After removal from the bath, the condition of the strip is compared with a set of standard strips and given a rating according to the standard strip most closely matched. The ratings range from 1 to 4 with letters a to d for intermediate ranges.

The results are reported in Table I below along with comparison lubricants containing products prepared using about 0.5 mole (1.0 gram atom of sulfur), per mole of reactive phenols, of sulfur monochloride, i.e. a stoichiometric amount of sulfur monochloride (Comparison 1) and about 0.4 mole (0.8 gram atom of sulfur) of sulfur monochloride per mole of reactive phenols (Comparison 2).

TABLE I

| | D-130 Copper Corrosion | | |
|---|---|---|---|
| | | Comparison | |
| Additive | Product of Ex 1 | 1 | 2 |
| 0.75 wt. % | lb | 4a | 4a |
| 1.20 wt. % | lb/trace deposit | — | — |

From the results reported in Table I, the product of the invention gave acceptable copper corrosion results whereas the products prepared using greater proportions of sulfur chloride caused severe copper corrosion.

EXAMPLE 2

To a 3-L reactor Were added 1,513.6 grams (6.67 moles) of the phenolic mixture used in Example 1 and 225 grams (1.67 moles) of $S_2Cl_2$ were slowly added to the reactor at room temperature over a period of 1 hour and 25 minutes. The temperature peaked at 41° C. during the $S_2Cl_2$ addition. The resulting batch was then heated and held at 50°–55° C. for 1 hour. $N_2$ was purged through the batch for 30 minutes followed by vacuum stripping for 30 minutes. The resulting material was filtered through a filter aid coated Whatman No. 54 paper. An amber liquid (1593 grams) was obtained which contained 6.76 wt percent sulfur and 0.63 wt percent chlorine.

A portion of the product was analyzed for unreacted 2,6-di-tert-butyl phenol (52.6 wt percent) and for the $S_2$–$S_6$ sulfur bridged phenols derived from 2,6-di-tert-butyl phenol (phenol di, tri, tetra, penta and hexasulfides) with the following result in wt percent.

| | |
|---|---|
| $S_2$ | 7.7 |
| $S_3$ | 5.1 |
| $S_4$ | 6.7 |
| $S_5$ | 1.4 |
| $S_6$ | 0.4 |

The copper corrosion test result at a 1.0 wt percent level of product in 5W-30 oil was 1*b*.

EXAMPLE 3

To a 2-L reactor were added 1,165.3 qrams (4.61 moles) of a phenolic mixture containing about 76 wt % 2,6-di-tert-butyl phenol, 4 wt % 2-tert-butyl phenol and 20 wt % 2,4,6-tri-tertbutyl phenol (a yellow clear liquid) and to it was added 160.0 grams (1.19 moles) of $S_2Cl_2$ dropwise at room temperature. A reddish brown liquid was gradually formed as the batch temperature gradually rose to 38°–41° C. The addition of $S_2Cl_2$ was completed in about 85 min. and the temperature peaked at 41° C. The resulting batch was then heated to 50°–53° C. and held for 1 hour and 30 minutes. The batch was then purged with $N_2$ for 30 min. followed by vacuum-stripping for 30 minutes. The resulting batch was filtered through a Whatman #1 coated with filter-aid to give a reddish-brown liquid weighing 1,227.4 grams. The product contained 50.3 weight percent of unreacted 2,6-di-tert-butyl phenol, 6.0 wt percent sulfur and 1.45 wt percent chlorine. The copper corrosion test result at a 0.75 wt percent level in 5W-30 oil was 1*b*.

EXAMPLE 4

To a 2-L reactor were added 1,139.0 grams of the phenolic mixture used in Example 1 and to the batch were added 258.1 grams of $SCl_2$ dropwise over a period of 4 hours. The slow addition rate was needed because of severe foaming. The batch temperature peaked at 47° C. during addition. After adding the $SCl_2$, the batch was held at 55° C. for 1 hour followed by a $N_2$ purge for 20 minutes. The resulting batch was then stripped in full vacuum for 30 minutes. The weight of the resulting neat product was determined and the proper amount 139.2 grams of process oil was then added to dilute the material into a 90% active product. The product contained 7.8 wt percent sulfur and 1.84 weight percent chlorine. Adding 0.76 weight percent product to a fully formulated 5W-30 oil resulted in a copper corrosion test result of 1*b*.

What is claimed is:

1. A liquid, partially sulfurized, hindered phenol product prepared by the process comprising reacting a liquid mixture of phenols, at least about 50 weight percent of said mixture consisting of one or more reactive, hindered phenols, with sulfur monochloride in proportions to provide from about 0.3 to 0.7 gram atoms of sulfur per mole of reactive, hindered phenol, so as to produce a liquid product.

2. The product of claim 1 wherein the liquid mixture of phenols comprises from about 50 to 90 weight percent of one or more reactive di-ortho, branched chain alkyl phenols.

3. The product of claim 2 wherein the liquid mixture of phenols comprises from about 50 to 85 weight percent of one or more reactive di-ortho, branched chain alkyl phenols.

4. The product of claim 3 wherein said mixture comprises from about 70 to 85 weight percent of 2,6-di-tert-butyl phenol.

5. The product of claim 4 wherein the product contains from about 30 to 75 weight percent of unreacted 2,6-di-tert-butyl phenol.

6. The product of claim 1 wherein said liquid product contains at least about 30 weight percent of unreacted, reactive, hindered phenol.

7. The product of claim 6 wherein said liquid product contains from about 40 to 75 weight percent of unreacted, reactive, hindered phenol.

8. The product of claim 1 wherein said liquid mixture contains at least two reactive, hindered phenols.

9. A process for making a liquid, partially sulfurized, hindered phenol product comprising reacting a liquid mixture of phenols, at least about 50 weight percent of said mixture consisting of one or more reactive, hindered phenols, with sulfur monochloride in proportions to provide from about 0.3 to 0.7 gram atoms of sulfur per mole of reactive, hindered phenol, so as to product a liquid product.

10. The process of claim 9 wherein the liquid mixture of phenols comprises from about 50 to 90 weight percent of one or more reactive di-ortho, branched chain, alkyl phenols.

11. The process of claim 10 wherein the liquid mixture of phenols comprises from about 50 to 85 weight percent of one or more reactive di-ortho, branched chain alkyl phenols.

12. The process of claim 11 wherein said mixture comprises from about 70 to 85 weight percent of 2,6-di-tert-butyl phenol.

13. The process of claim 12 wherein the product contains from about 30 to 75 weight percent of unreacted 2,6-di-tert-butyl phenol.

14. The process of claim 9 wherein said liquid product contains at least about 30 weight percent of unreacted, reactive, hindered phenol.

15. The process of claim 14 wherein said liquid product contains from about 40 to 75 weight percent of unreacted, reactive, hindered phenol.

16. The process of claim 9 wherein said liquid mixture contains at least two reactive, hindered phenols.

17. A lubricant comprising an oil of lubricating viscosity and from about 0.05 to 5.0 weight percent of the product of claim 1.

18. A lubricant composition comprising an oil of lubricating viscosity and from about 0.05 to 5.0 weight percent of the product of claim 4.

19. An additive concentrate comprising oil or solvent and from about 0.5 to 50 weight percent of concentrate of the product of claim 1.

* * * * *

UNITED STATES PATENT AND TRADEMARK OFFICE

CERTIFICATE OF CORRECTION

PATENT NO. : 5,009,802

DATED : April 23, 1991

INVENTOR(S) : William Y. Lam and Gregory P. Liesen

It is certified that error appears in the above-identified patent and that said Letters Patent is hereby corrected as shown below:

On the title page, item [73]:

Assignee: reads "Ethyl Corporation", but should read
-- Ethyl Petroleum Additives, Inc. --

Column 6:

Claim 9, line 18, reads "so as to product", but should read
-- so as to produce --

Signed and Sealed this

Seventeenth Day of November, 1992

*Attest:*

DOUGLAS B. COMER

*Attesting Officer*

*Acting Commissioner of Patents and Trademarks*